United States Patent [19]

Henrici et al.

[11] Patent Number: 4,895,526

[45] Date of Patent: Jan. 23, 1990

[54] CONNECTING TERMINAL BLOCK FOR ELECTRICAL APPARATUS

[75] Inventors: Dieter Henrici; Erwin Lingemann, both of Arnsberg, Fed. Rep. of Germany

[73] Assignee: Firma Brokelmann, Jaeger & Busse GmbH & Co., Arnsberg, Fed. Rep. of Germany

[21] Appl. No.: 296,260

[22] Filed: Jan. 11, 1989

[30] Foreign Application Priority Data

Feb. 9, 1988 [DE] Fed. Rep. of Germany ... 8801623[U]

[51] Int. Cl.[4] ..... H01R 4/66; H01R 13/73

[52] U.S. Cl. ..... 439/108; 439/409; 439/571

[58] Field of Search ..... 439/557, 748, 746, 567, 439/572, 552, 555, 747, 872, 92, 108, 81, 82, 78, 571

[56] References Cited

U.S. PATENT DOCUMENTS

| | | | |
|---|---|---|---|
| 3,790,915 | 2/1974 | Dugan et al. | 439/557 |
| 3,910,663 | 10/1975 | Winger | 439/92 |
| 4,006,872 | 2/1977 | Tanner | 439/557 |
| 4,728,295 | 3/1988 | Henrici et al. | 439/84 |

FOREIGN PATENT DOCUMENTS

| | | | |
|---|---|---|---|
| 77318 | 1/1962 | France | 439/557 |

*Primary Examiner*—Gary F. Paumen

*Attorney, Agent, or Firm*—Herbert Dubno

[57] ABSTRACT

A terminal block with grounding capabilities has a stamped plug of U configuration whose bight is adapted to be forced into an opening in a terminal carrier for grounding thereto and whose shanks engage in a conductive element within the body. The shanks extend continuously from the bight to connecting portions which engage in recesses in the conductive element in the body and one of the shanks has a nose reaching over and in form-locking relationship with this conductive element.

6 Claims, 2 Drawing Sheets

CONNECTING TERMINAL BLOCK FOR ELECTRICAL APPARATUS

FIELD OF THE INVENTION

Our present invention relates to a connecting terminal block, for an electrical apparatus and, more particularly, to a terminal block for making electrical connections for lamps, stoves, washing machines and other electrical apparatus for appliances, especially utilizing a protective terminal or contact which can be grounded.

BACKGROUND OF THE INVENTION

A connecting terminal block of the aforedescribed type may be used in any electrical apparatus or appliance, especially a heavy-duty electrical apparatus of appliance in which conductors of the apparatus are to be electrically connected to conductors connected to the main or electric supply line. In general, one contact of the terminal block can be considered to be a protective contact and can be connected to a grounding wire of the apparatus, a grounding wire of the supply source and either body or housing of the apparatus.

For that apparatus the terminal block can comprise an insulated body in which the connector contacts are arranged to make electrical connections between the various conductors of the supply source and the apparatus and which can include at least one protective contact which may also make an electrical connection with a wall of the apparatus upon which a terminal unit is mounted.

Of particular interest for the purposes of the invention is a terminal unit of the aforedescribed type in which the protective or grounding contact is a plug stamped from flat thin sheet metal and having two shanks which are received in a slot in the terminal body and are connected by a bight portion of the plug engageable in a window or slot in the wall of the housing or other structure of the apparatus to which the terminal block is to be affixed, e.g. by this plug.

The portion of the insulating body of the terminal provided with the slot in which the two-arm plug is received can thus be held against the wall of the apparatus provided with the window into which the plug fits and in which this plug is mechanically anchored.

The shanks or arms of the plug may form-fittingly and clampingly engage in recesses, cutouts or windows of the protective contact element within the body into which the grounding conductor of the supply source or the apparatus or both may be electrically connected.

The invention has as its basis the terminal block shown in FIG. 4 of German open application No. DE-OS 36 21 369 and the corresponding U.S. Pat. No. 4,728,295, issued Mar. 1, 1988 and commonly assigned with the present application. The two shanks which engage the contact element within the insulating body are here interconnected by a bridge piece which fits into the slot in the insulating body, while the plug portion has a U shape with a pair of arms lying wholly outside the body so as to be receivable in an appropriate slot or hole in the wall of the apparatus upon which the terminal block is to be mounted.

The two shanks rising from the bridge piece engage in openings in the protective contact element with the intention of providing an electrically effective contact therewith. The spring action is here formed between two arms of the U, wholly externally of the terminal body.

While this plug-type grounding connector has been found to be highly satisfactory in use, we have found that it is possible to improve upon the engagement of the grounding contact with the contact element within the terminal body, specifically by making that contact simpler and more effective for the purposes described.

OBJECTS OF THE INVENTION

It is thus the principal object of the present invention to provide an improved terminal block of the type described in the aforementioned U.S. patent but with a better capability for grounding and mounting and a more effective grounding contact or plug member.

Another object of the invention is to simplify the terminal block, especially with respect to its grounding contact.

It is also an object of our invention to provide a terminal block having an improved grounding capability, affording better anchorage to the wall of the apparatus to which the terminal block is applied.

SUMMARY OF THE INVENTION

These objects and others which will become apparent hereinafter are attained, in accordance with the present invention, in a connecting terminal block for an electric apparatus having a wall adapted to receive the terminal block and wherein the terminal block comprises:

an insulating body formed with a chamber and at least one inlet opening into the chamber and adapted to receive a conductor to be connected by the terminal block and at least one slot opening from the chamber toward the wall;

conductor means including at least one conductive element received in the chamber, engageable with the conductor and formed with a pair of spaced-apart first opening for making electrical contact with the conductor; and a two-shank generally U-shaped plug constituted from thin flat sheet metal and having a bight and a pair of shanks unitarily connected to the bight and coplanar with the bight, the shanks each extending unitarily into a connecting shank part at a respective free end of the respective shank, the plug being received in the slot with the bight projecting from the slot into locking engagement in an opening in the wall and connecting shank parts engaging the conductive element in respective second openings thereof, the opening in the wall having a clear width which is at least slightly smaller than the largest distance between outer edges of the shanks.

In accordance with the invention, therefore, the two shanks of the plug extend continuously into the connecting shank portions without interruption by a bridge piece or the like and the two connecting portions of the plug which generally has an overall U shape, are engaged in respective lodgements, recesses or cutouts in the protective contact element within the body and which is adapted to be electrically connected to a grounding conductor of the supply and, if desired, to a grounding conductor of the load, i.e. of the electrically powered apparatus.

The clear width of the receiving opening in the wall is dimensioned in accordance with the invention to be at least slightly smaller than the greatest distance between the small outer edges of the shanks from one another, i.e. the outer edges of the shank which project from the insulating body.

The most significant difference between the plug of the instant invention and the plug formation of the commonly-owned U.S. patent mentioned previously is that the retaining function of the plug against the protective contact element is no longer independent of the clamping action of the plug within the opening in the supporting wall.

This is ensured by having the connecting shank portions which actually provide an electrical contact with the protective contact element within the body continuous with the portions of the shanks which are urged together as the plug is thrust into the opening in the support wall. The pressing of the two shanks together can simultaneously bring about a forced engagement of the connecting portions of these shanks with the contact element, something that was not possible when the contact portions of the plug were held apart by a bridge piece or the like in the earlier system. Indeed, a tongs-like grouping or engagement of the contact element can be ensured with the system of the invention.

As a consequence, not only is there a resiliently effective force-fit between the support wall and the plug, but also between the plug and the contact element within the insulating body of the terminal for both effective mechanical and electrical connection therebetween.

While, in the earlier system current could only flow through one arm of the U-shaped plug to the support wall in a grounding action, the present system permits both shanks or arms of the U to be effective electric-current carriers.

Furthermore, these advantages are achieved without additional cost in a simplified construction which can be fabricated by a simple stamping process.

According to a further feature of the invention, at least one of the two shanks on the free end thereof engages in a cutout or opening in the protective contact element within the body and has a nose turned toward the free end of the other shank and adapted to reach over the margin of the contact element provided with this opening.

Upon insertion of the plug into the opening of the support wall or terminal carrier, the pressing of the two shanks together provides a tong-like action and forces which ensures that the nose will grip the edge of the opening in the protective contact element through which the nose has been inserted. Not only does this ensure a firm electrical contact between the contact element and the plug, but also a form-locking engagement of the contact element by the plug so that the contact element cannot pull loose from the plug. Furthermore, the plug can be provided with barbs or lugs which engage behind the wall through which the plug is inserted to prevent undesired separation.

According to another feature of the invention, therefore, from the sheet metal of the plug, a pair of lugs or barbs is stamped and bent in opposite directions from the sheet metal plane to engage behind the terminal carrier.

These detent tongues can project from the inner edge of the bight of the U and can diverge in opposite directions, but it goes without saying that where the tongues extend from the bight of the U, they are unitary therewith.

The barbs thus are pressed toward the plane in which the plug is inserted in the slot forming the opening in the terminal carrier and then spring outwardly transversely to the plane of the plug to engage beneath the opposite edges of the slot. Because of the combination of the barbs and the resiliently displaceable shanks, the retention function of the plug is greatly improved by comparison with the earlier terminal device of the aforementioned U.S. patent.

The invention thus provides a terminal block which can be used for effective grounding to and of the apparatus on which the terminal is mounted with better current-carrying capacity and more effective retention to the terminal carrier and engagement of the protective contact within the terminal body.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
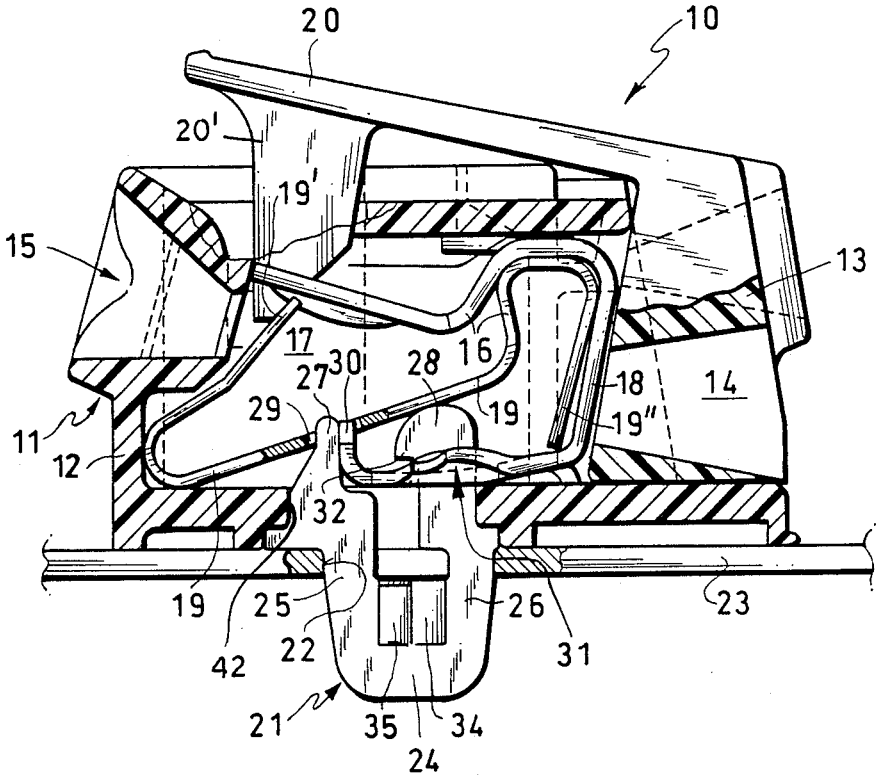
FIG. 1 is a cross-sectional view of the terminal block of the invention taken in the region of the protective contact element and plug according to the invention.

The terminal block represented generally at 10 comprises a two-part insulating body 11 of a synthetic resin material, with a base member 12 adapted to be retained against the wall 23 constituting the carrier member of the electrical apparatus to which the terminal block is to be affixed and grounded. The second part 13 of the insulating housing is provided with a displaceable member as described in the foregoing patent so that, upon depression, it will deflect the blade portion 19' of the respective contact element to allow release of a conductor inserted through the inlet opening or guide 15 as has been described in the aforementioned patent.

The terminal block is therefore provided with a number of such inlet openings or guides 15 and through which the supply conductors can be individually fed to make electrical contact with the respective contact elements. Only the grounding contact element 16 is shown in the drawing since only this contact element is provided with a plug for grounding to the wall 23.

Additional inlet ports 14 can be provided, e.g. for the conductors connected to the electrical load of the apparatus provided with this terminal block.

The openings 14 and 15 communicate with a chamber 17 which receives the grounding contact element represented as a whole by the reference numeral 16 and consisting of the two clamping members 18 and 19. Member 18 is a generally U-shaped and relatively intrinsically stiff bent bar, for example of copper, or some other material of high electrical conductivity.

Member 19 is an intrinsically resilient contact spring with spring contact shanks 19' and 19'', respectively juxtaposed with the openings 15 and 14, respectively. The bent bar 18 serves as a carrier and holder for the contact spring 19. The shanks 19' and 19'' form elastic tongues which can be deflected inwardly upon insertion of the respective conductors so as to bite into the conductors and retain the conductors against the bar 18. As a consequence, the tongues form a screwless connection clamp for the respective conductors.

The tongue or shank 19' can be deflected away from the bar 18 to release a conductor when a push-button 20 of the upper part 13 of the elastic body is depressed. To this end, the push-button carries a projection 20' positioned to engage member 19'. This allows removal of the grounding conductor.

The plug for grounding the contact element 16 to the wall 23 and for holding the terminal block against the latter has been represented at 21 and can be fitted into an opening or slot 42 formed in the base 12 and into a window or slot 22 of the terminal carrier 23. This terminal carrier can be a metallic wall.

The plug 21 is a simple sheet metal stamping which can have a thickness of say 0.5 mm. Its basic outline is that of a U. Its bight 24 is therefore provided with two U shanks 25 and 26 and these shanks can be pressed in the plane of the plug corresponding to the drawing plane in FIG. 1, elastically toward one another and have a tendency to spring outwardly away from one another when pressed inwardly.

The free ends of the two U shanks 25 and 26 form two connecting shanks or arms 27 and 28 for coupling with the grounding contact element 16.

Specifically, the connecting shank 27 engages in a cutout 29 of the contact spring 29 in which an upwardly bent tongue 30 of the grounding bar 18 also engages as can be seen from FIG. 1.

The other connecting shank 28 extends through a gap 31 in the grounding bar 18 which is constituted as a clamping slit and has an inwardly directed nose 32 which has a downwardly turned edge of this nose 32a adapted to overhang and engage the edge of the slit 31 to ensure a form-locking retention of the plug 21 by the bar 18.

Figure 4:
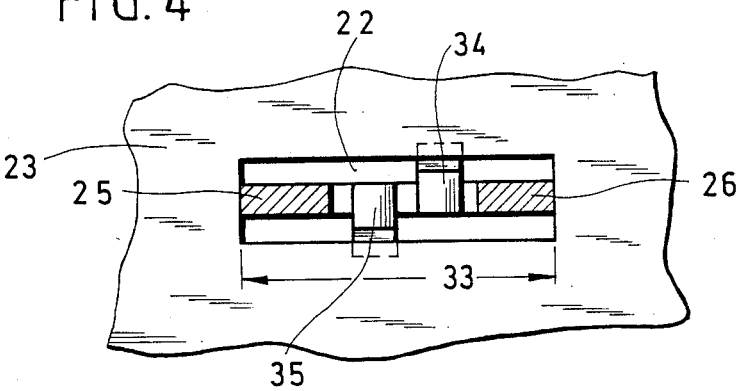
FIG. 4 is a cross-sectional view taken along the line IV - IV of FIG. 2 but illustrating the wall and slot into which the plug is inserted.

The slot 22 in the terminal holder 23 can be seen to be of elongated rectangular configuration (FIG. 4) with a clear length 33 which is slightly smaller than the maximum spacing of the small outer edges of the plug shanks 25 and 26 at the largest spacing thereof externally of the insulating body 12, 13.

Figure 2:
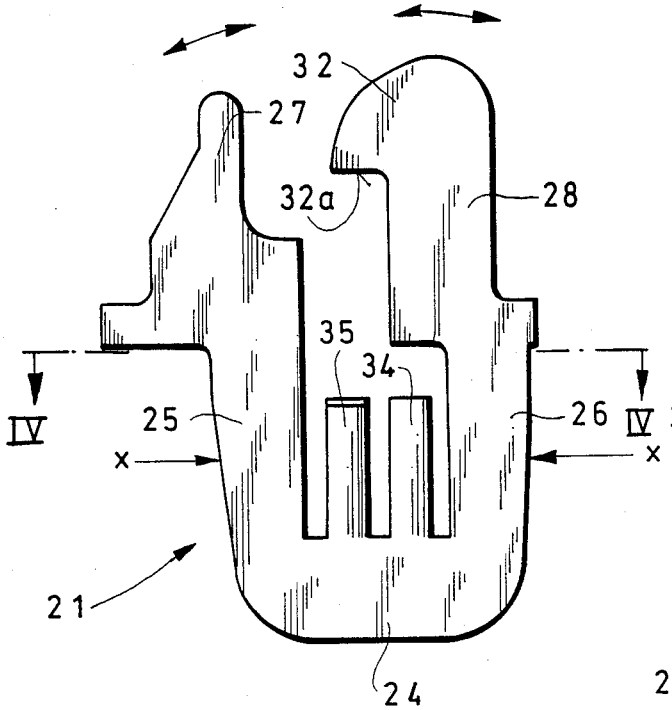
FIG. 2 is an elevational view of the grounding plug drawn to a much greater scale than that of FIG. 1.

The clear width 33 will depend upon manufacturing tolerances and will be slightly smaller than the spacing between the outer edges of the shanks 25 and 26 in the sectional plane IV—IV shown in FIG. 2 and can correspond to the distance between these outer edges in the region X—X of this Figure.

When the plug 21 is forced into the slot 22, the shanks 25 and 26 are resiliently bent toward one another to reinforce the engagement of the plug with the grounding contact element 16. This, of course, increases the electrical contact between the two. The resilient outward force which the plug applies to the edges of the slot 22 of wall 23 increases the mechanical force with which the plug is held in the support 23, and thus the force with which the terminal block is retained on the wall 23.

Figure 3:
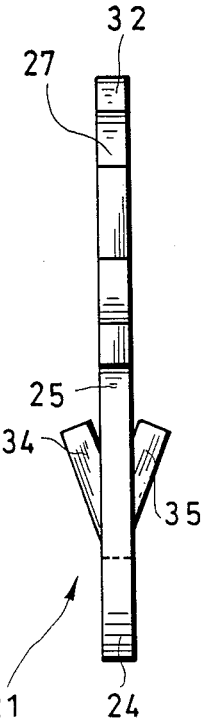
FIG. 3 is a side elevational view of the plug of FIG. 2.

From the inner edge of the bight 24, two spring lugs 34, 35 project upwardly and are bent in opposite directions out of the plane of the plug as can be seen from FIG. 3, i.e. these lugs 34 and 35 diverge in the direction of the terminal block. The lugs 34 and 35, moreover, engage beneath the longitudinal edges of the opening 22 as can be seen from FIG. 4 to increase the retention force with which the plug is held in the opening 22.

The lateral edges of the shanks 25 and 26 in the region of the outer portions of the plug 22 can be sharp-edged if desired so as to be able to bite through and pierce any insulating lacquer which may be applied to the inner edges of the opening 22 as an insulating medium.

We claim:

1. A connecting terminal block for an electric apparatus having a wall adapted to receive said terminal block, said terminal block comprising:

an insulating body formed with a chamber and at least one inlet opening into said chamber and adapted to receive a conductor to be connected by said terminal block and at least one slot opening from said chamber toward said wall;

conductor means including at least one conductive element received in said chamber, engageable with said conductor and formed with a pair of spaced-apart first openings for making electrical contact with said conductor; and a two-shank generally U-shaped plug constituted from thin flat sheet metal and having a bight and a pair of shanks unitarily connected to said bight and coplanar with said bight, said shanks each extending unitarily into a connecting shank part at a respective free end of the respective shank, said plug being received in said slot with said bight projecting from said slot into locking engagement in an opening in said wall and said connecting shank parts engaging said conductive element in respective second openings thereof, the opening in said wall having a clear width which is at least slightly smaller than the largest distance between outer edges of said shanks.

2. The terminal block defined in claim 1 wherein at least one of said shanks is formed at the respective free end thereof with a nose turned toward the other of said shanks and engaged over said element upon traversing the respective opening in said conductor means.

3. The terminal block defined in claim 1 wherein said plug is formed with lugs unitary with said plug and bent out of a common plane of said bight and of said shanks and engageable behind said wall for locking said plug in said opening of said wall.

4. The terminal block defined in claim 3 wherein said lugs are formed on and extend from said bight and diverge in different directions from said plane.

5. The terminal block defined in claim 1 wherein at least one of said shanks is formed at the respective free end thereof with a nose turned toward the other of said shanks and engaged over said element upon traversing the respective opening in said conductor means.

6. The terminal block defined in claim 5 wherein said body is formed with a further inlet opening into said chamber for receiving another conductor engageable with said conductive element.

* * * * *